US006782760B2

(12) United States Patent
Goldau et al.

(10) Patent No.: US 6,782,760 B2
(45) Date of Patent: Aug. 31, 2004

(54) METHOD FOR THE FINISHING TREATMENT OF WORKPIECES

(75) Inventors: Harald Goldau, Klein-Gübs (DE); Peter Brust, Wuppertal (DE)

(73) Assignee: Thielenhaus Technologies GmbH, Wuppertal (DE)

( * ) Notice: Subject to any disclaimer, the term of this patent is extended or adjusted under 35 U.S.C. 154(b) by 30 days.

(21) Appl. No.: 10/337,211

(22) Filed: Jan. 6, 2003

(65) Prior Publication Data

US 2003/0154799 A1 Aug. 21, 2003

(30) Foreign Application Priority Data

Jan. 17, 2002 (DE) ..... 102 01 639

(51) Int. Cl.[7] ..... G01N 19/00
(52) U.S. Cl. ..... 73/804
(58) Field of Search ..... 73/763, 781, 788, 73/787, 804, 805

(56) References Cited

U.S. PATENT DOCUMENTS 3,672,200 A * 6/1972 Ogasawara ..... 72/285
3,895,424 A * 7/1975 Hautau ..... 29/38 C
4,571,814 A * 2/1986 Palfery et al. ..... 483/14
4,778,313 A * 10/1988 Lehmkuhl ..... 409/127
6,174,271 B1 * 1/2001 Kosmowski ..... 483/1
6,477,927 B1 * 11/2002 Albo et al. ..... 82/1.11
6,592,430 B1 * 7/2003 Nakasuji et al. ..... 451/9

FOREIGN PATENT DOCUMENTS

DE 199 52 805 8/2000

* cited by examiner

*Primary Examiner*—Max Noori
(74) *Attorney, Agent, or Firm*—Collard & Roe, P.C.

(57) ABSTRACT

A method for the finishing treatment of work pieces, uses a processing device including a tool spindle for a processing tool and a numerically controlled (NC) feeding device. The force of the contact pressure applied to the work piece on the side of the work piece is measured and the measured force values are supplied to the numerical control (NC), which determines and fixes the feed rate at which the processing tool is advanced against the work piece. The finishing treatment is carried out in a force-controlled operating mode, in which the feed rate is controlled depending on the force of the contact pressure acting on the processing tool. A processing device is employed whose tool spindle is movably supported in the direction of the feeding movement on leaf springs on the feeding device. The processing device includes a force-measuring device effective between the tool spindle and the feeding device and operating substantially free of deformation. In the force-controlled operating mode, feed rate values are allocated to the values measured by the force-measuring device at a cycle control frequency preset by the numerical control (NC), whereby the allocation is fixed according to a damping function.

6 Claims, 5 Drawing Sheets

METHOD FOR THE FINISHING TREATMENT OF WORKPIECES

BACKGROUND OF THE INVENTION

CROSS REFERENCE TO RELATED APPLICATIONS

Applicants claim priority under 35 U.S.C. §119 of German Application No. 102 01 639.9 filed Jan. 17, 2002.

1. Field of the Invention

The present invention relates to a method for the finishing treatment of work pieces with the use of a processing device including a processing tool and a numerically-controlled (NC) device for feeding (or advancing) the tool. The force of the contact pressure applied by the tool for processing or working the work piece is measured on the side of the work piece and the values measured for the force are supplied to the numerical control (NC) that determines the rate at which the processing tool is advanced against the work piece. The finishing treatment is carried out in a force-controlled operating mode in which the feeding rate is controlled depending on the force of contact pressure acting on the working tool.

2. The Prior Art

In the finishing treatment of work pieces, it is necessary to control the movements of the rotating working tool with high precision in order to satisfy high requirements with respect to the accuracy to size and the surface quality of the surface of a work piece being processed. The feed has to be controlled so that the processing tool rests with a defined force against the surface of the work piece to be treated. In the normal case, this force amounts to less than 100 Newtons (N). In the finishing treatment of very small work pieces, forces of contact pressure in the order of magnitude of from 1 to 50 N have to be specifically adjusted with only minimal deviations from the norm.

A method characterized by the features described above is known from DE 199 52 805 A1. In this known method, the feeding device employed is a carriage with a numerically controlled (NC) linear motor that serves as the device feeding the tool. The linear motor is characterized by high dynamics and is controlled depending on the force of the contact pressure acting on the processing tool. The carriage has to be supported free of friction in order to permit precise, force-controlled tool-feeding movements. To accomplish this known method requires extensive technical expenditure.

SUMMARY OF THE INVENTION

The object of the invention is to provide a method for the finishing treatment of work pieces with which force-controlled feeding movements of the processing tool are possible with a force of contact pressure that can be adjusted in a delicate and precise manner. Furthermore, the aim is to be able to carry out the method as well with mechanical tool-feeding devices whose setting movements are afflicted with friction.

These and other objects are achieved, in accordance with the invention, by providing a method which employs a device for processing the work piece in which the tool spindle is movably supported on leaf springs on the feeding device and can be driven in the direction of the feeding movement. The processing device includes a device for measuring the force that is effectively working substantially free of deformation and is located between the tool spindle and the feeding device. In the force-controlled operating mode, feed rate values are allocated to the force-measuring system at a cycle control frequency that is predetermined by the numerical control (NC).

The allocation between the values for the force and the feed rate is fixed according to a damping function so that the feeding rate increases with a drop in the measured value of the force, and decreases with a rise of the value of the measured force. This process continues until the value of the measured force corresponds within permissible tolerances with a preset value.

According to the invention, the tool spindle is supported on leaf springs that are aligned transversely in relation to the direction of the feed. The leaf springs, which are arranged vertically and clamped with a short free length, are highly elastic and flexible in the direction of the feed, so that forces of contact pressure applied to the tool spindle are transmitted to the force-measuring system delicately and practically free of loss. In particular when these leaf springs are clamped with a short free length, they are capable of absorbing high vertical forces as well as high transverse forces. The leaf springs are therefore suited for alone supporting the tool spindle on the feeding device without requiring any additional guide between the tool spindle and the tool-feeding device that is afflicted with friction. A carriage driven by a roller spindle can be employed as the feeding device. Frictions occurring in the carriage guide as well as between the roller spindle and the carriage have no effect on the measurement of the force of the contact pressure at which the processing tool is applied against the surface of the work piece. The method as defined by the invention permits a highly sensitive control of the force of the finishing treatment process. Forces of contact pressure are reproducible down to 1 N and can be adjusted with precision and can also be maintained throughout the course of the finishing treatment process in the force-controlled operating mode.

The force-measuring device employed is preferably a piezo element, i.e. a piezoelectric element, that is clamped between a connecting element secured on the tool spindle, and a bearing block arranged on the feeding device. This piezo electric element transmits forces of contact pressure acting on the tool spindle to the feeding device substantially without any deformation.

Suited for the method as defined by the invention are also feeding devices capable of performing multi-axes feeding movements. These devices include a number of feeding drives corresponding with the number of axes. The feed drives associated with the axes are controlled by the numerical control (NC) so that the superposed feed in the direction in which the force of the tool spindle is acting takes place according to the force-controlled mode described above.

According to a further embodiment, the tool spindle for the finishing treatment of a new work piece is advanced in the high-speed mode until a first (or starting) cut of the work piece by the processing tool is recognized via a measuring signal of the force-measuring device. The feeding movement of the tool spindle is stopped by the numerical control (NC) with the recognition of the first (or starting) cut, and the further finishing operation takes place in the force-controlled operating mode. The nominal value of the force applied for the finishing treatment may be varied according to a time function incrementally in steps or continually. The method as defined by the invention permits the finishing treatment of work pieces with defined forces of contact pressure that are optimally coordinated with the work piece as well as with the working tool, specifically with only negligible minor deviations from the norm. When smallsized work pieces are processed, it is possible to achieve forces of contact pressure down to 1 N. The finishing results obtainable with the method as defined by the invention have a very good geometry and very good surface characteristics. By controlling the force, overloading of the processing tool can be avoided, which is advantageously reflected by low wear of the processing tool.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Figure 1:
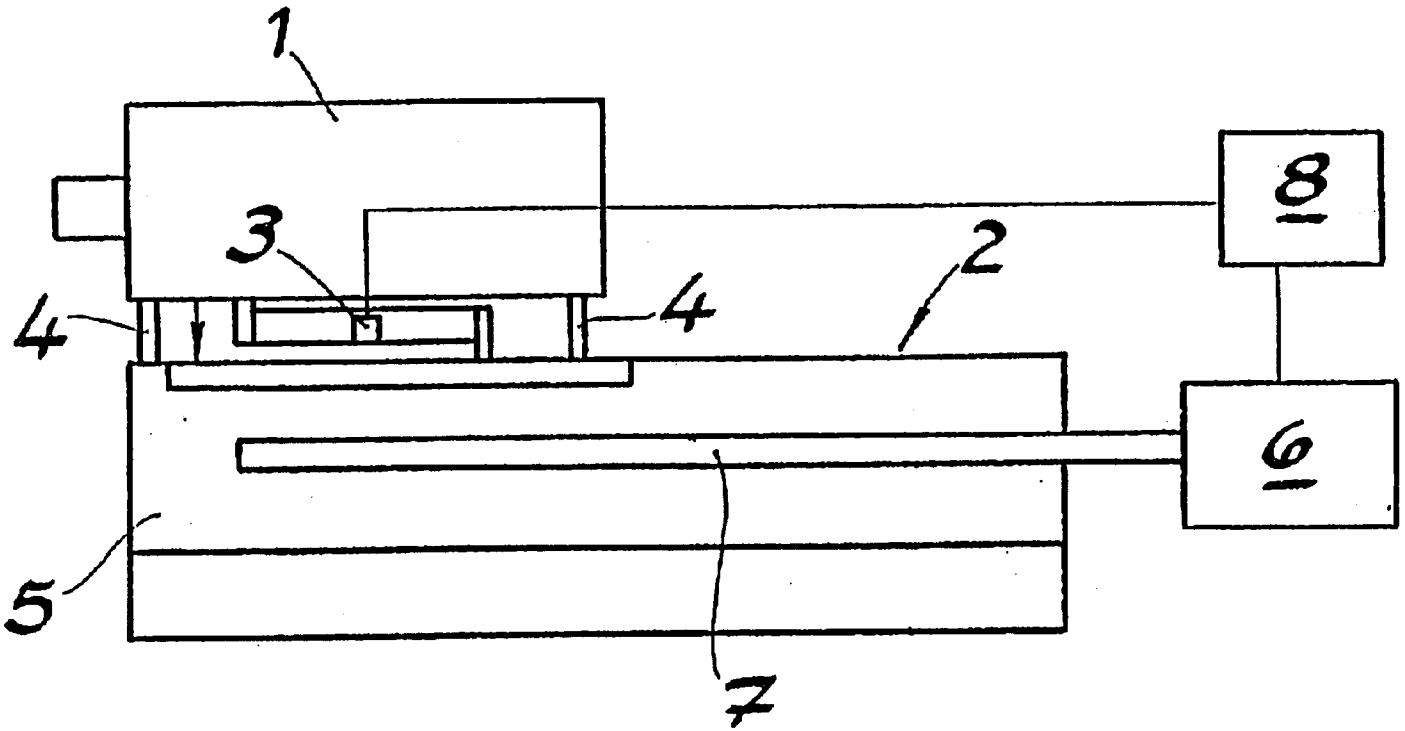
FIG. 1 is a schematic showing a device for the finishing treatment of work pieces according to an embodiment of the method as defined by the invention.

Referring now to the drawings, FIG. 1 shows a device which serves for the finishing treatment of work pieces and is particularly suited for working or processing small-pieced series production parts made of metal or ceramics as well. The basic structure of the device includes a tool spindle 1 designed, for example, in the form of a high-speed motor spindle; a numerically controlled (NC) feeding device 2, as well as a force-measuring device 3 that operates between the tool spindle 1 and the feed device 2 substantially free of deformation. This measuring device measures the force F of the contact pressure acting on tool spindle 1 in the process for finishing a work piece. Tool spindle 1 is supported on feeding device 2 by means of leaf springs 4, which are aligned transversely in relation to the direction of the tool feed. A piezo electric element is employed as force-measuring device 3. This piezo electric element is clamped between a connecting element secured on tool spindle 1 and a bearing block arranged on feeding device 2. Feeding device 2 includes a carriage 5 with a precision carriage guide designed according to the state of the art, as well as a driving assembly in the form of a roller spindle 7 driven by a motor 6. Other types of design of the feeding device may be used. It is possible to employ multi-axle tool-feeding devices as well.

Figure 2:
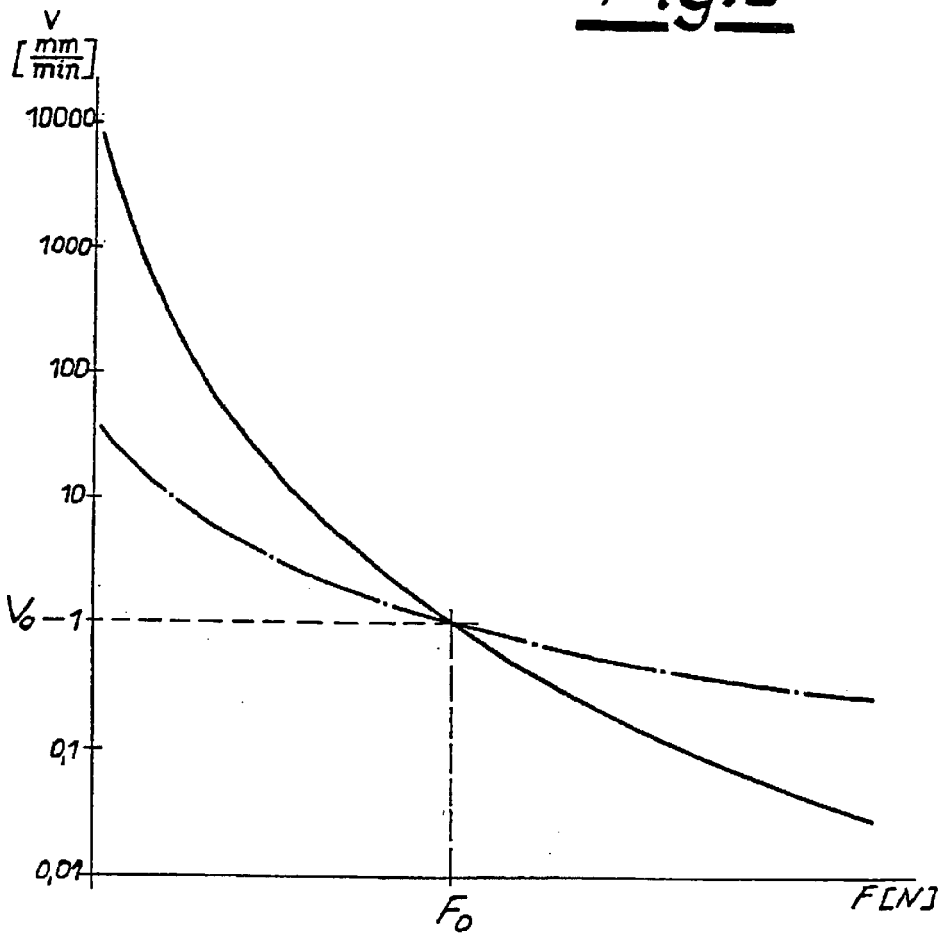
FIG. 2 is a feed rate/force diagram showing the changes in the feed rate of the processing tool in dependence on the force of contact pressure acting on the processing tool in the course of a finishing treatment in the force-controlled operating mode.

The force F of the contact pressure applied to the tool spindle on the side of the work piece is measured. The values measured for the force are supplied to a numerical control (NC) 8, which determines and fixes the rate (or speed) V at which the processing tool is advanced against the work piece. The finishing treatment is carried out in a force-controlled operating mode in which the feed rate V is controlled in dependence on the contact pressure force F acting on the processing tool or tool spindle 1. Feed rate values are allocated to the values measured by force-measuring device 3 with a cycle control frequency preset by numerical control (NC) 8, for example at time intervals of from two to four milliseconds. This allocation is implemented according to a damping function that is schematically shown in FIG. 2. The damping function is selected for the specific case of application. The damping function is set so that the feed rate increases when the measured force value F decreases, and is reduced when the measured force value rises, until the measured force value F corresponds with a preset nominal force value $F_o$ within permissible tolerances. The cycle control frequency at which the feed rate values V are allocated to the measured force values F, is dependent on the numerical control (NC) 8 and amounts to a few milliseconds in practical applications. In the force-controlled operating mode, the desired nominal force value $F_o$ and the feed rate $V_o$ allocated to that nominal force value are reached very quickly and are precisely maintained throughout the course of the finishing treatment process. This is clearly shown in FIGS. 3 to 5, in which the time curves of the force F of the contact pressure acting on the processing tool or tool spindle, as well as the feed rate V at which tool spindle 1 is advanced against the work piece, are each plotted for a finishing processing operation.

Figure 3:
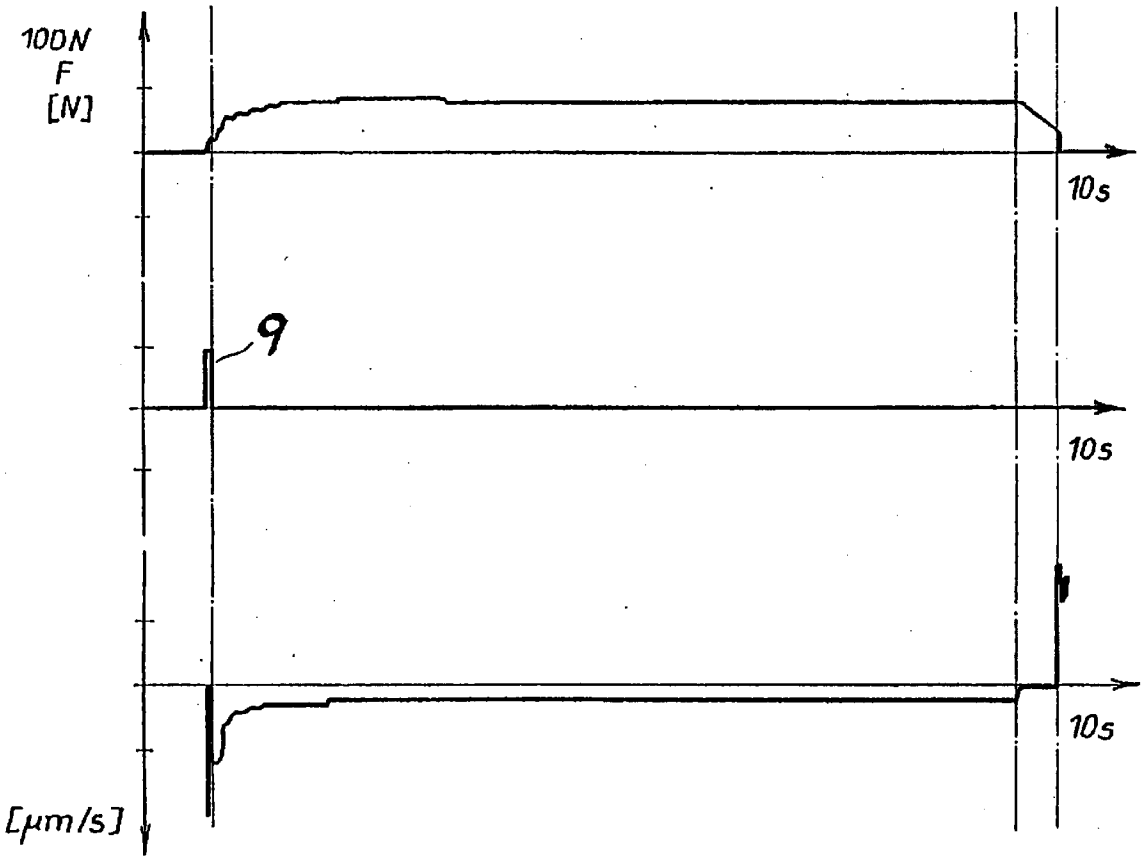
FIG. 3 is a time curve of the force of contact pressure acting on the processing tool and the feed rate when the method as defined by the invention is carried out.
Figure 4:
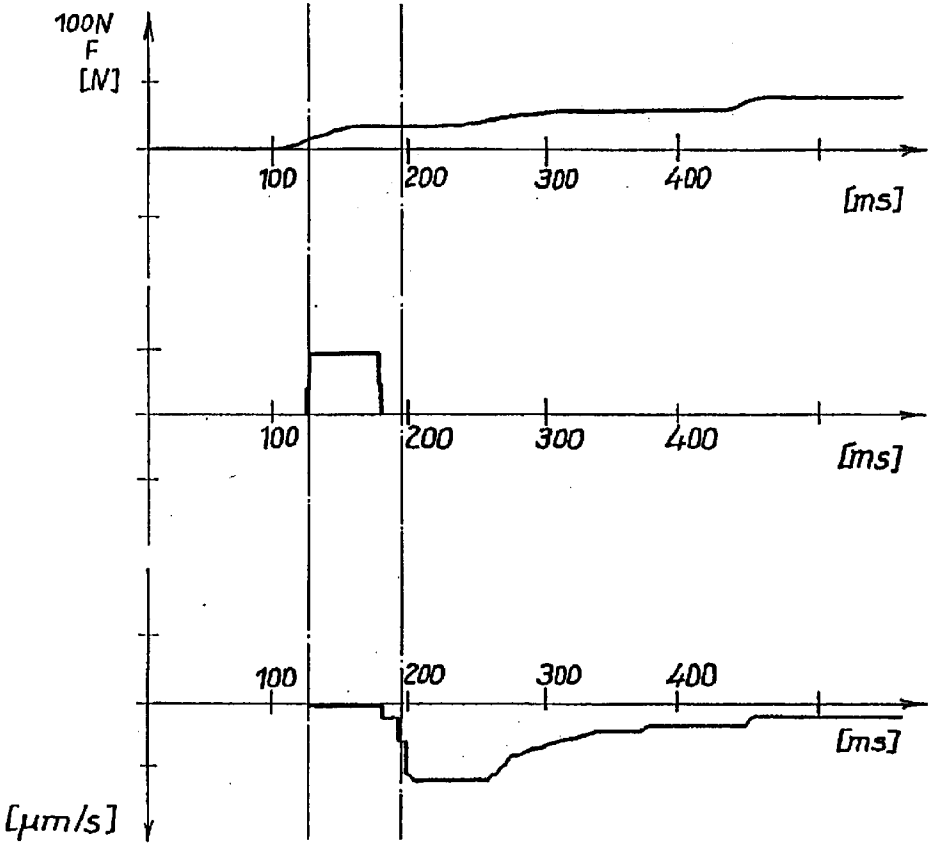
FIG. 4 is a section from FIG. 3 on a time scale that has been changed versus FIG. 3.
Figure 5:
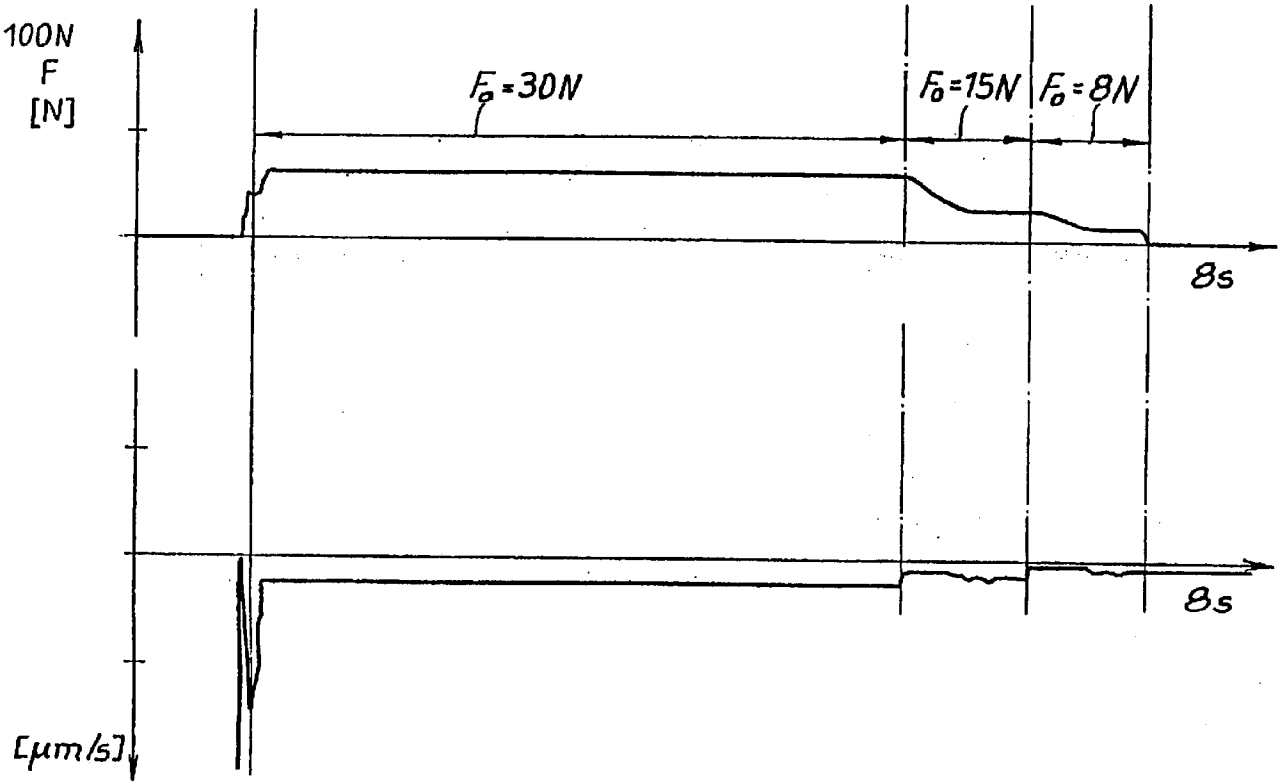
FIG. 5 are time curves of the force of contact pressure acting on the processing tool, as well as the feed rate in a process that is controlled in a changed manner as compared to FIG. 3.

When a new work piece is to be finished, tool spindle 1 is advanced at a pre-selected feed rate, not shown according to scale in FIGS. 3 to 5, for example at a feed rate of 300 $\mu$m/s in the high-speed mode. Tool spindle 1 is advanced at the pre-selected feed rate until an initial cut by the working tool has been recognized by a measuring signal of force-measuring device 3. The recognition of the initial cut on the work piece is represented in FIGS. 3 and 4. The recognition of the initial cut causes the feeding (or advancing) movement of tool spindle 1 to be stopped by numerical control (NC) 8 by means of a trigger signal 9. The effect of the force-controlled operating mode sets in with a minimal time delay if any unsteadiness occurs that is conditioned by computing cycles of numerical control (NC) 8. In the exemplified embodiment, this time delay amounts to about 65 milliseconds, and the feed rate is allocated to the given values measured for the force subject to the selected damping function. FIGS. 3 and 4 show that the force values F correspond with the preset nominal force value $F_o$ after a short processing time, and that this nominal value of the force is constantly maintained throughout the finishing treatment process. Following the finishing treatment that took place in the force-controlled operating mode, the feeding (or advancing) movement is stopped and feeding device 2 is maintained in this position until the force of contact pressure acting on the working tool has been largely reduced. Subsequently, tool spindle 1 is driven away from the work piece with feeding device 2, which is indicated in FIG. 3 by negative values of the feed rate. The resetting movement can be triggered in a force-controlled manner if the measured force value has dropped below a preset threshold value.

In the operating mode shown in FIG. 5, the nominal force value $F_o$ for the finishing treatment in the force-controlled operating mode is varied in steps (or incrementally) according to a time function. In the exemplified embodiment, the initial (or starting) nominal force value $F_o$ is reduced from 30 N to 15 N, and finally to 8 N during an end (or final) phase of the finishing treatment process. The feed rate values V are adjusted by numerical (NC) control 8 subject to the damping function in a manner such that the altered values of the nominal force are reached already in a short time.

While only a few embodiments of the present invention have been shown and described, it is to be understood that many changes and modifications may be made thereunto without departing from the spirit and scope of the invention as defined in the appended claims.

What is claimed is:

1. A method for finishing a work piece at a preset force value comprising the steps of:

(a) providing a processing device having a tool spindle for a processing tool movably supported in a direction of feed movement via leaf springs on a feeding device coupled to a numerical control (NC);

(b) measuring a contact pressure force applied by the processing tool on a side of a work piece using a force-measuring device disposed between said tool spindle and said feeding device operating substantially without deformation;

(c) allocating feed rate values to corresponding measured force values at a cycle control frequency preset by said numerical control; and (d) supplying contact pressure force values to the said numerical control for control of a feed rate at which the processing tool is advanced against the work piece in accordance with a selected damping function for a particular application so that in carrying out a finishing treatment in a force-controlled operating mode the feed rate increases with decrease in measured force value and decreases with increase in measured force value, until the measured force value substantially corresponds with the preset force value.

2. The method according to claim 1 further comprising:

advancing the tool spindle against the work piece at a high-speed rate until an initial cut of the work piece by the processing tool has been recognized by a measuring signal of the force-measuring device;

stopping feeding movement of the tool spindle by the numerical control when the initial cut has been recognized; and carrying out further processing in the force-controlled operating mode.

3. The method according to claim 1 wherein the feeding device comprises a carriage driven by a roller spindle.

4. The method according to claim 1, wherein the force-measuring device is a piezo electric element clamped between a connecting element secured on the tool spindle and a bearing block arranged on the feeding device, said piezo electric element transmitting forces of contact pressure acting on the tool to the feeding device substantially free of deformation.

5. The method according to claim 1, wherein the feeding device performs a multi-axis feeding movement; and the feeding associated with the axes are controlled by the numerical control (NC) so that a superposed feed takes place in the force-controlled operating mode in the direction in which the force is acting.

6. The method according to claim 1, wherein the preset force value for the finishing treatment is varied incrementally or continually in the force-controlled operating mode.

* * * * *